US007656354B2

(12) United States Patent
Park et al.

(10) Patent No.: US 7,656,354 B2
(45) Date of Patent: Feb. 2, 2010

(54) ANTENNA APPARATUS FOR PORTABLE TERMINAL

(75) Inventors: Jung-Ho Park, Suwon-si (KR); Wan-Jin Choi, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 339 days.

(21) Appl. No.: 11/453,580

(22) Filed: Jun. 15, 2006

(65) Prior Publication Data

US 2006/0284773 A1 Dec. 21, 2006

(30) Foreign Application Priority Data

Jun. 15, 2005 (KR) ..... 10-2005-0051511

(51) Int. Cl.
*H01Q 1/24* (2006.01)

(52) U.S. Cl. ..... 343/702; 343/700 MS; 343/762; 343/795

(58) Field of Classification Search ..... 343/700 MS, 343/702, 873, 795, 813, 815, 821, 753, 762, 343/779, 785
See application file for complete search history.

(56) References Cited

U.S. PATENT DOCUMENTS

| | | | | |
|---|---|---|---|---|
| 4,814,776 | A | 3/1989 | Caci et al. | |
| 5,940,041 | A | 8/1999 | Koyama et al. | |
| 6,348,894 | B1 * | 2/2002 | Lahti | 343/702 |
| 6,448,932 | B1 * | 9/2002 | Stoiljkovic et al. | 343/700 MS |
| 6,650,294 | B2 * | 11/2003 | Ying et al. | 343/700 MS |
| 6,670,925 | B2 * | 12/2003 | Iwai et al. | 343/702 |
| 6,850,198 | B2 * | 2/2005 | Robin | 343/702 |
| 6,873,292 | B2 * | 3/2005 | Yoo et al. | 343/702 |
| 6,936,921 | B2 * | 8/2005 | Yoshida | 257/728 |
| 7,339,533 | B2 * | 3/2008 | Kurashima et al. | 343/702 |
| 2003/0193438 | A1 | 10/2003 | Yoon | |
| 2003/0231134 | A1 | 12/2003 | Yarasi et al. | |
| 2004/0207557 | A1 * | 10/2004 | Chen et al. | 343/702 |
| 2006/0019730 | A1 * | 1/2006 | Kim et al. | 455/575.7 |

FOREIGN PATENT DOCUMENTS

| | | |
|---|---|---|
| GB | 2 281 661 | 3/1995 |
| WO | WO 01/91228 | 11/2001 |
| WO | WO 02/37603 | 5/2002 |
| WO | WO 02/078123 | 10/2002 |

* cited by examiner

*Primary Examiner*—Douglas W Owens
*Assistant Examiner*—Chuc D Tran
(74) *Attorney, Agent, or Firm*—The Farrell Law Firm, LLP

(57) ABSTRACT

Disclosed is an antenna apparatus for a portable terminal which includes radiation elements received in a housing of the portable terminal; contact arms formed on the radiation elements; and feeding pads disposed on both surfaces of a printed circuit board, wherein the contact arms are in contact with the feeding pads. The contact arms respectively come in contact with each feeding pad. The pair of feeding pads is attached to the printed circuit board while the contact arms are provided on the radiation elements so as to come in contact with the each feeding pad, so that the antenna apparatus may satisfy operation criteria of wide and multi bands. In addition, the radiation elements are formed as a pair, one of which satisfies the operation criteria of double and triple bands and the other of which has resonance frequency of other bands, so that the operation criteria of the multi bands can be effectively achieved.

11 Claims, 5 Drawing Sheets

ANTENNA APPARATUS FOR PORTABLE TERMINAL

PRIORITY

This application claims priority to an application entitled "Antenna Apparatus for Portable Terminal" filed with the Korean Intellectual Property Office on Jun. 15, 2005 and assigned Serial No. 2005-51511, the contents of which are incorporated herein by reference.

BACKGROUND OF THE INVENTION

1. Field of the Invention

The present invention relates to a portable terminal, and more particularly to a power feed structure for an interior antenna for a portable terminal.

2. Description of the Related Art

In general, the term "portable terminal" refers to a communication device which provides an electronic communicating function for a user to wirelessly communicate with another user or a service provider by way of relay stations. The user can carry the portable terminal with him/her while using various services such as voice communication, short message sending, and mobile banking services, as well as various contents such as TV programs, online games, video on demand (hereinafter, referred to as VOD) and the like.

Conventional portable terminals may be classified into various types according to their appearance, such a bar-type portable terminal which has a communication circuit, a transmitter, a receiver and data input/output unit in a housing, a flip-type portable terminal which has a transmitter, a receiver and data input/output unit installed on a housing similar to the bar-type portable terminal and in which the data input/output unit, such as a keypad, is opened and closed by means of a flip panel, and a folder-type portable terminal which has a pair of housings which include a transmitter, a receiver and data input/output unit separately disposed therein and one of which can be folded towards the other. Recently, a sliding-type portable terminal and the like have become commercially available together with the folder-type portable terminal to satisfy various consumer demands and to improve portability and convenient use.

In addition, the user can use various mobile communication services, such as game, moving picture file transmitting, mobile banking, VOD, digital multimedia broadcasting and the like services, on line by using the portable terminals. As the use of the portable terminal is universal while various consumer demands are increased, it is possible to provide a variety of mobile communication services because the environment of commercially providing the service to use various contents exists.

The portable terminal is provided with an antenna apparatus in order to secure reception and communication quality above a certain level even in a changing wave environment according to surrounding conditions. The antenna apparatus provided on the portable terminal has different standards, for example, length, according to an available frequency band of the service provider.

These antenna apparatuses can be classified into an interior antenna installed in the housing of the portable terminal and an exterior antenna extending out of the housing of the portable terminal. The interior antenna includes a loop antenna, an inverted L-shaped antenna, a planar inverted F-shaped antenna and the like. The exterior antenna may be a helical antenna in an antenna housing and a telescopic antenna apparatus which is extracted from and retracted into the housing of the portable terminal, of which the antenna housing is exposed or projected out of the housing of the portable terminal.

Recently, the use of an interior antenna apparatus has gradually increased to improve the portability of the portable terminal, to prevent damage to the portable terminal due to external impact and to facilitate various designs of the portable terminal. Wide and multiple bands of the interior antenna can be achieved by branching away a part of antenna pattern which extends from a power supplying portion according to the diversification of the mobile communication service. However, there is a problem in that the conventional interior antenna apparatus cannot sufficiently receive many of the mobile communication services. In the conventional interior antenna, that is, it is emphasized that the antenna apparatus is mounted in the housing of the portable terminal and is not projected outside the housing, which limits the establishment of wide and multi bands of the antenna apparatus.

SUMMARY OF THE INVENTION

Accordingly, the present invention has been made to solve the above-mentioned problems occurring in the prior art, and an object of the present invention is to provide an antenna apparatus for a portable terminal which can satisfy the criteria of wide and multi bands of the antenna apparatus.

Another object of the present invention is to provide an antenna apparatus for a portable terminal which can stably connect an interior antenna to the feeding pad of a printed circuit board.

In order to accomplish these objects, there is provided an antenna apparatus for a portable terminal, including radiation elements received in a housing of the portable terminal; contact arms formed on the radiation elements; and feeding pads disposed on both surfaces of a printed circuit board, wherein the contact arms are in contact with the feeding pad.

In order to accomplish these objects, there is provided an antenna apparatus for the portable terminal, including radiation elements received in a housing of the portable terminal; contact arms formed on the radiation elements; and feeding pads disposed on both surfaces of a printed circuit board, wherein the contact arms are formed as a pair which extend from an edge of each radiation element while facing each other and are in contact with the feeding pads disposed on both surfaces of the printed circuit board.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE PREFERRED EMBODIMENT

Hereinafter, a preferred embodiment of the present invention will be described with reference to the accompanying drawings. In the following description of the present invention, a detailed description of known functions and configurations incorporated herein is omitted to avoid making the subject matter of the present invention unclear.

Figure 1:
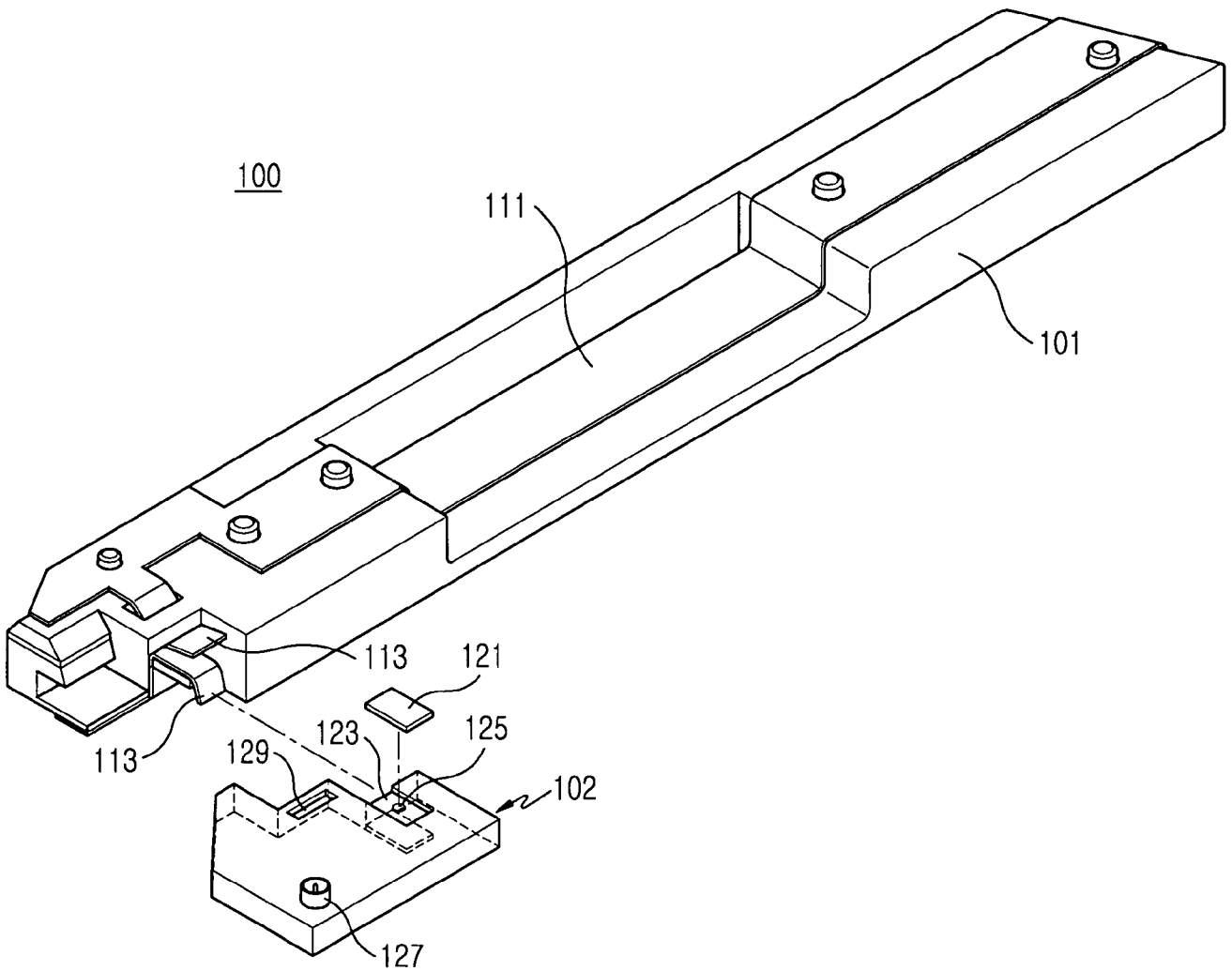
FIG. 1 is a perspective view showing an antenna apparatus for a portable terminal according to a preferred embodiment of the present invention.
Figure 2:
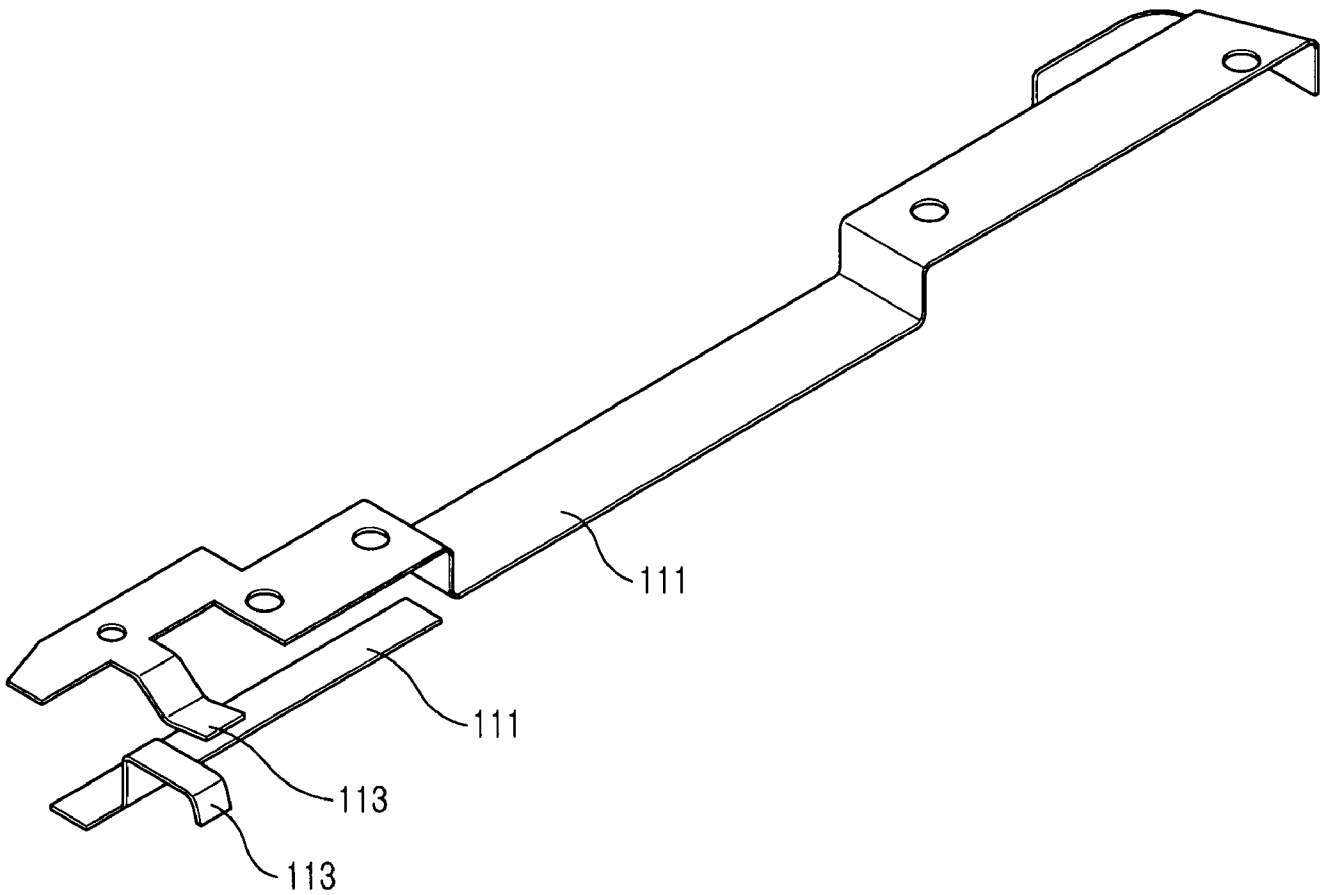
FIG. 2 is a perspective view showing a structure of a radiation element according to an embodiment of the present invention, which can be employed in the antenna apparatus shown in FIG. 1.
Figure 3:
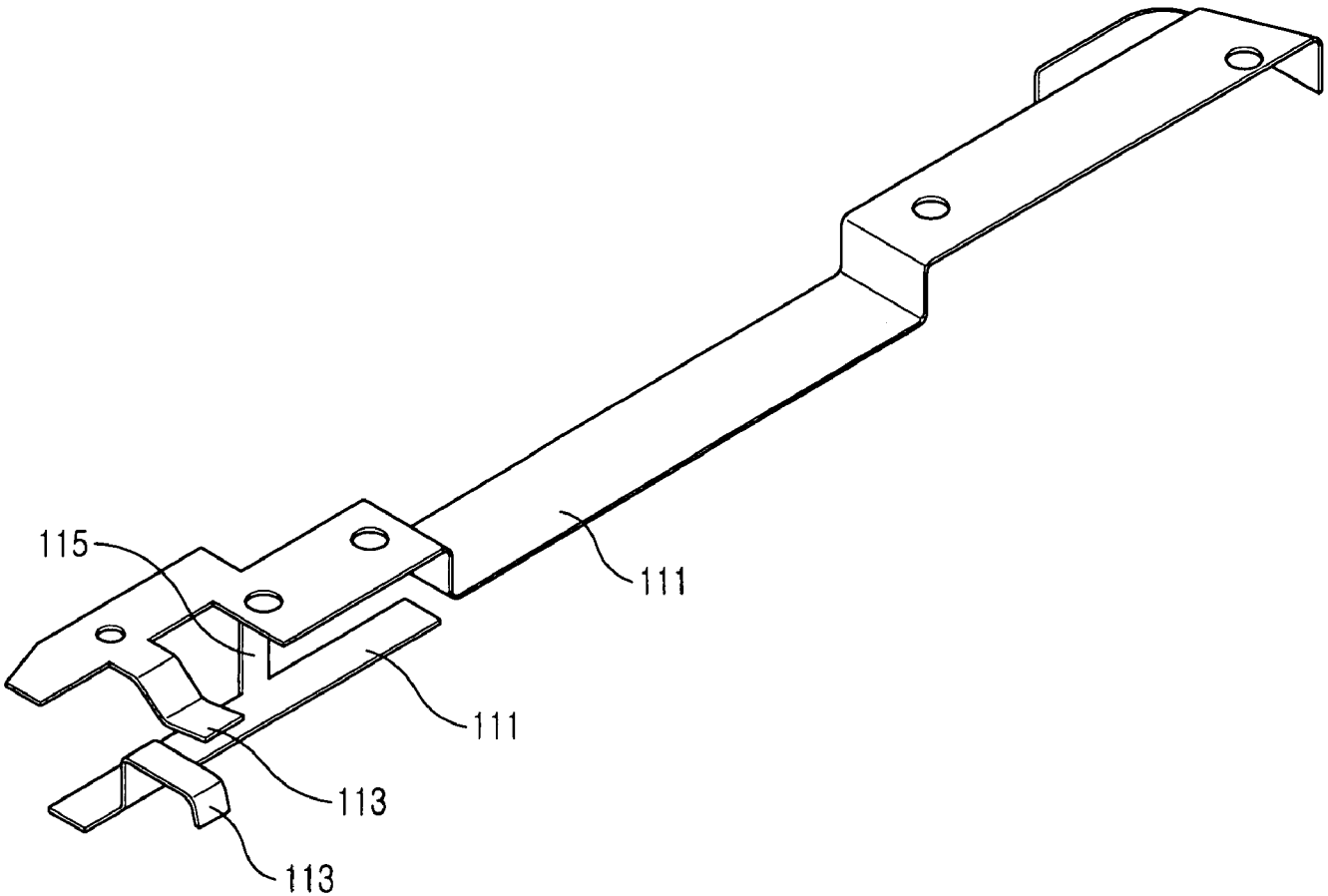
FIG. 3 is a perspective view showing a structure of a radiation element according to another embodiment of the present invention, which can be employed in the antenna apparatus shown in FIG. 1.
Figure 4:
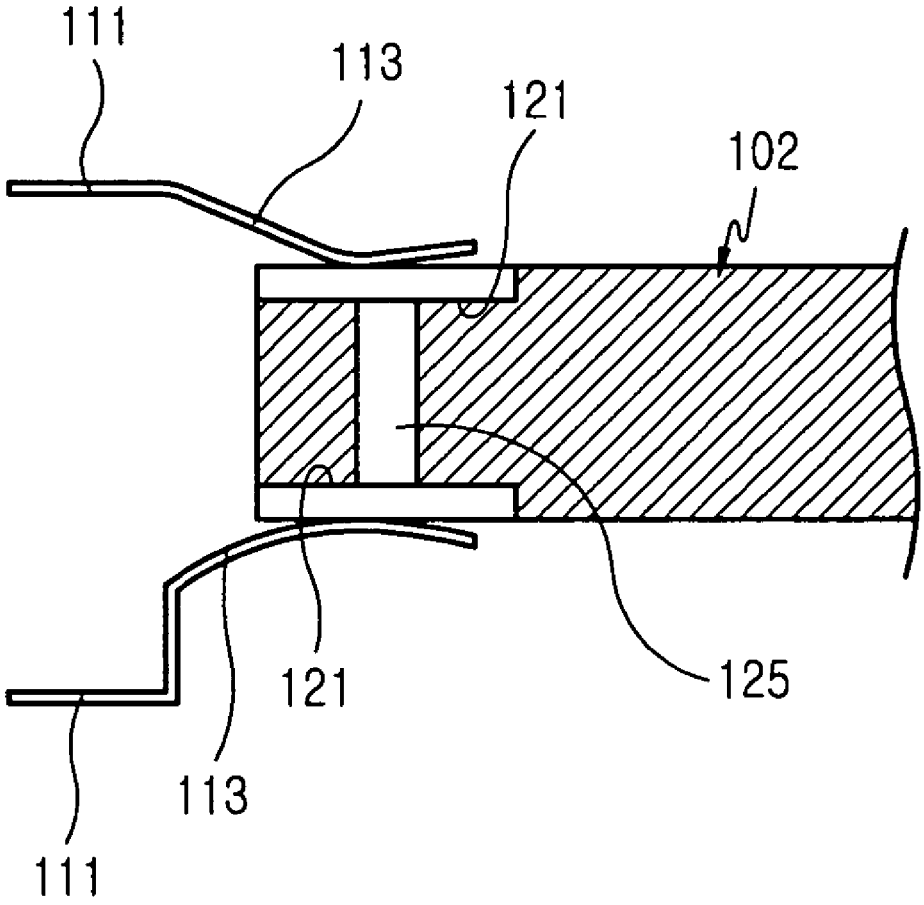
FIG. 4 is a side view in partial cut-away of the radiation element shown in FIG. 2, in which contact arms of the radiation element are in contact with a feeding pad.
Figure 5:
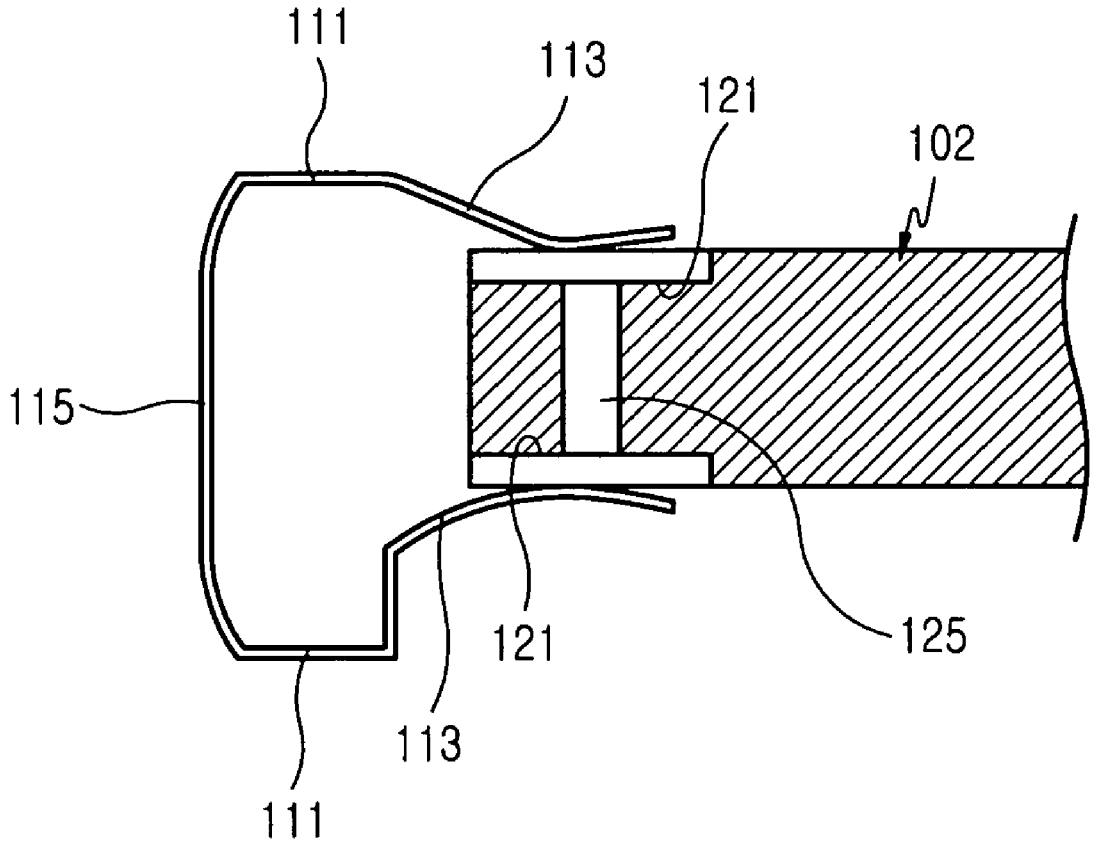
FIG. 5 is a side view in partial cut-away of the radiation element shown in FIG. 3, in which contact arms of the radiation element are in contact with a feeding pad.

As shown in FIGS. 1 to 5, the antenna apparatus 100 for the portable terminal according to the preferred embodiment of the present invention has a structure in that a contact arm 113 of a radiation element 111 is in contact with a feeding pad attached to each surface of a printed circuit board 102. Here, the radiation elements 111 shown in FIGS. 2 and 3 respectively include a pair of radiation elements facing each other. FIG. 2 shows the radiation elements 111 which are separated from each other, and FIG. 3 shows the radiation elements 111 connected to each other by means of a connecting member 115.

As shown in FIGS. 1 to 3, the radiation elements 111 are attached to an antenna base 101. The radiation elements 111 may have various shapes according to type of antenna apparatus required for the portable terminal. The antenna base 101 has a shape which can stably fix the radiation elements 111 to the antenna base 101. That is, the antenna base 101 has surfaces respectively formed to correspond to each shape of the radiation elements 111 which are attached thereto.

The antenna base 101 is preferably made from an insulating material such as synthetic resin and is fixed in a housing (not shown) of the portable terminal. The radiation elements 111 are made along with the antenna base into a module which in turn is mounted in the housing of the portable terminal during assembly. At this time, the radiation elements 111 are assembled to operate independently. However, the radiation elements 111 may be electrically connected with each other to operate together.

The radiation elements 111 have at least one contact arm 113. In the embodiment of the present invention, a pair of contact arms 113 are provided, which respectively extend from each radiation element 111 to face each other. The antenna base 101 has supporting holes, supporting ribs and the like in order to prevent the radiation elements 111 opposed to each other from being spaced away from each other more than a predetermined distance. Such supporting members for supporting the radiation elements can be formed by properly modifying the shape of the antenna base 101.

Referring to FIGS. 2 and 3, the structure of the radiation elements 111 will be described in more detail hereinafter. The pair of radiation elements 111 face each other, each respectively having a contact arm 113 extending from each radiation element 111. Such radiation elements 111 may be connected with each other by means of the connecting member 115. Where the radiation elements 111 are connected with each other by means of the connecting member 115, the radiation elements 111, contact arms 113 and the connecting member 115 are made of a conductive metal sheet by plating and bending processes, each of these elements have been named based on their functions in the receiving and transmitting operation of the antenna apparatus 100. In addition, the radiation elements 111, the contact arms 113 and the connecting member 115 can be separately made and then assembled on the antenna base 101. In consideration of productivity, assembly, and the loss caused by contact between the structural elements during the transmitting and receiving operation of the antenna apparatus, it is preferable to integrally manufacture the radiation elements 111, the contact arms 113 and the connecting member 115 through plating and bending of a single piece conductive metal sheet.

One of the planar inverted F-shaped antenna, the inverted L-shaped antenna, the loop antenna, a meander line antenna and the like can be selectively used as the radiation elements 111 because these antennas can be easily miniaturized and contained in the portable terminal as well as to satisfy the requirements of the portable terminal.

Each of the radiation elements 111 is connected through the contact arm 113 to a feeding pad 121 attached to the printed circuit board 102. As shown in FIG. 1, the printed circuit board 102 has a groove 129 to fix the printed circuit board 102 to the antenna base 101. The fixing groove 129 is engaged with a hook (not shown) formed on the antenna base 101 so that the printed circuit board 102 is secured to the antenna base 101 while a part of a lower surface of the printed circuit board 102 is supported by means of the antenna base 101. The securing structure of the printed circuit board 102 may be modified according to the shape of the antenna base 101. For example, while the present embodiment proposes the hook and groove as the securing structure, screw holes may be formed in the printed circuit board 102 and the antenna base 101, so that the printed circuit board 102 is screwed to the antenna base 101 in such a manner that the printed circuit board is generally fixed to a housing of a terminal by means of the screw.

Feeding pads 121 are disposed on both surfaces of the printed circuit board 102. The feeding pads 121 are attached to seating surfaces 123 formed on both surfaces of the printed circuit board 102, respectively. The seating surfaces 123 are electrically connected to each other via a through-hole 125. That is, the feeding pads 121 are electrically connected to each other through-hole 125.

On the other hand, while the present embodiment discloses that the seating surfaces 123 are separately formed in the printed circuit board 102 in order to attach the feeding pads 121 to the seating surfaces 123, it may be difficult to give the printed circuit board 102 enough thickness to form the seating surfaces 123 by depressing both surfaces of the printed circuit board 102, in consideration of the fact that the antenna apparatus is mounted in the portable terminal. In the case in which it is difficult to provide a sufficient thickness of the printed circuit board 102, a power supply pattern can be printed on the printed circuit board 102 to provide the feeding pads to the printed circuit board 102 similar to the printed circuit pattern.

When the printed circuit board 102 is combined and secured to the antenna base 101, the feeding pads 121 constructed as described above are in contact with the opposed contact arms 113. At this time, the shape of the antenna base 101 prevents the contact arms 113 from being separated from each other more than a predetermined distance. Therefore, each of the contact arms 113 forces the feeding pads 121 to maintain stable contact.

Meanwhile, the printed circuit board 102 may be integrated with a main board (not shown) of the portable terminal. Where the printed circuit board 102 is integrated with the main board, the feeding pads 121 are connected to a transmitting and receiving circuit through the printed circuit pattern provided on the main board.

In the present embodiment, the printed circuit board 102 is a small circuit board made separately from the main board and has a coaxial connector 127 electrically connected to the feeding pads 121 on a surface of the printed circuit board 102.

The printed circuit board 102, specifically the feeding pads 121, is preferably connected to the transmitting and receiving circuit of the main board by means of the coaxial connector 127 and a coaxial cable (not shown).

In the antenna apparatus of the portable terminal according to the present invention as described above, a pair of feeding pads is attached to the printed circuit board while the contact arms provided on the radiation elements come in contact with the each feeding pad, thereby facilitating the manufacture of the antenna apparatus having operation criteria of wide and multi bands. In addition, the radiation elements are formed as a pair, one of which satisfies the operation criteria of double and triple bands and the other of which has resonance frequency of another bands, so that the operation criteria of the multi bands can be effectively achieved.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An antenna apparatus for a portable terminal, comprising:

radiation elements received in a housing of the portable terminal;

contact arms formed on the radiation elements;

feeding pads disposed on both surfaces of a printed circuit board; and at least one through-hole formed in the printed circuit board, wherein the feeding pads are electrically connected to each other via the at least one through-hole and each of the contact arms is in contact with one of the feeding pads, respectively.

2. The antenna apparatus for the portable terminal as claimed in claim 1, wherein the contact arms are formed as a pair and extend from an edge of each radiation element so as to face each other and are in contact with the feeding pads provided on both surfaces of the printed circuit board.

3. The antenna apparatus for the portable terminal as claimed in claim 1, wherein the radiation element is one of a planar inverted F shaped antenna, an inverted L shaped antenna, a loop antenna and a meander line antenna.

4. The antenna apparatus for the portable terminal as claimed in claim 1, wherein the radiation elements are formed as a pair to face each other, and the contact arms extend from the radiation elements.

5. The antenna apparatus for the portable terminal as claimed in claim 4, further comprising a connecting member which electrically connects the radiation elements with each other.

6. The antenna apparatus for the portable terminal as claimed in claim 1, wherein the printed circuit board is a main board of the portable terminal.

7. The antenna apparatus for the portable terminal as claimed in claim 1, further comprising an antenna base which is fixed in the housing of the portable terminal, wherein the radiation elements are attached to the antenna base.

8. The antenna apparatus for the portable terminal as claimed in claim 7, wherein the printed circuit board is fixed to the antenna base.

9. The antenna apparatus for the portable terminal as claimed in claim 8, further comprising a coaxial connector for connecting a coaxial cable, which is provided on the printed circuit board.

10. The antenna apparatus for the portable terminal as claimed in claim 1, wherein the printed circuit board further includes seating surfaces formed on the printed circuit board to receive the feeding pads.

11. An antenna apparatus for a portable terminal, comprising:

radiation elements received in a housing of the portable terminal;

contact arms formed on the radiation elements;

feeding pads disposed on both surfaces of a printed circuit board; and at least one through-hole formed in the printed circuit board, wherein the feeding pads are electrically connected to each other via the at least one through-hole and the contact arms are formed as a pair to extend from an edge of each radiation element while facing each other and each of the contact arms is in contact with one of the feeding pads disposed on both surfaces of the printed circuit board, respectively.

* * * * *

UNITED STATES PATENT AND TRADEMARK OFFICE

CERTIFICATE OF CORRECTION

PATENT NO. : 7,656,354 B2
APPLICATION NO. : 11/453580
DATED : February 2, 2010
INVENTOR(S) : Park et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 503 days.

Signed and Sealed this

Thirtieth Day of November, 2010

David J. Kappos

David J. Kappos
*Director of the United States Patent and Trademark Office*